US006209625B1

(12) United States Patent
Guo

(10) Patent No.: US 6,209,625 B1
(45) Date of Patent: Apr. 3, 2001

(54) HEAT PIPE WITH HYDROGEN GETTER

(76) Inventor: Zhen Guo, 2535 SW. 115 Ave., Miami, FL (US) 33165

( * ) Notice: Subject to any disclaimer, the term of this patent is extended or adjusted under 35 U.S.C. 154(b) by 0 days.

(21) Appl. No.: 09/332,678

(22) Filed: Jun. 14, 1999

(51) Int. Cl.[7] ..... F28D 15/00
(52) U.S. Cl. ..... 165/104.21; 165/104.27
(58) Field of Search ..... 165/104.27, 104.21, 165/104.26

(56) References Cited

U.S. PATENT DOCUMENTS 3,896,042 * 7/1975 Anderson et al. ..... 252/184
4,043,387 * 8/1977 Lamp ..... 165/104.27
4,455,998 * 6/1984 Kroontje et al. ..... 126/635
4,586,561 * 5/1986 Franco et al. ..... 165/104.27
4,668,424 * 5/1987 Sandrock ..... 252/181.3
4,782,890 * 11/1988 Shimodaira et al. ..... 165/104.27
4,884,628 * 12/1989 En-Jian et al. ..... 165/104.27
5,703,378 * 12/1997 Sheppodd et al. ..... 252/182.12

* cited by examiner

*Primary Examiner*—Ira S. Lazarus
*Assistant Examiner*—Tho Duong

(57) ABSTRACT

Disclosed is an improved heat pipe construction. The heat pipe includes a tubular enclosure with upper and lower ends enclosed by end caps. One such end cap employs a communication port such that a working fluid can be introduced into the interior of the pipe. Water is disclosed as the working fluid in the preferred embodiment. The water is adapted absorb heat from the surrounding atmosphere evaporate and condense it the upper portion of the pipe. Typically, a portion of the water reacts with the container to evolve non-condensable hydrogen gas. Such gas diminishes the effectiveness of the heat pipe. To reduce the hydrogen gas a active agent is employed. The opposite end cap of the pipe includes a container into which a volume of the active agent is positioned. A preferred active agent composition includes 96 percent by weight $PbO_x$ and 4 percent by weight $PbSo_4$. The $PbO_x$ is preferably electrochemically formed, with x varying between 1.85 and 2.05. Disclosed are various active agent formulations and active agent containers.

6 Claims, 1 Drawing Sheet

HEAT PIPE WITH HYDROGEN GETTER

BACKGROUND OF THE INVENTION

1. Field of the Invention

The present invention relates to a new and improved heat pipe and, more particularly, pertains to a heat pipe with a more efficient means to remove unwanted hydrogen gas.

2. Description of the Prior Art

The use of heat pipes is known in the prior art. Furthermore, heat pipes which employ hydrogen oxidation means are also known. The prior art discloses various heat pipes. By way of example, U.S. Pat. No. 4,884,628 to En-Jian et al. discloses a heat pipe with a hydrogen oxidation means, specifically a sintered mixture containing Cu and CuO. U.S. Pat. No. 4,782,890 to Shimodaira et al. discloses a heat pipe with a solid oxidizing agent. U.S. Pat. No. 4,586,561 to Franco discloses a low temperature heat pipe with a zirconium intermetallic alloy getter material. Finally, U.S. Pat. No. 4,403,561 discloses a heat pipe with a residual gas collector vessel.

In this respect, the heat pipe according to the present invention substantially departs from the conventional concepts and designs of the prior art, and in doing so provides an apparatus primarily developed for the purpose of more efficiently removing hydrogen gas from the interior of the pipe.

Therefore, it can be appreciated that there exists a continuing need for a heat pipe which enables improved heat transference. In this regard, the present invention substantially fulfills this need.

SUMMARY OF THE INVENTION

In view of the foregoing disadvantages inherent in the known types of heat pipes now present in the prior art, the present invention provides a new and improved heat pipe with improved hydrogen oxidization means.

To attain this, the present invention essentially comprises a new and improved heat pipe device which reduces the amount of non-condensable hydrogen gas within its interior. The device includes a tubular enclosure formed from a lower region, an upper region, an upper end and a lower opened end, a tubular wall extending in between the upper and lower ends. The wall is formed from a ferrous metal alloy selected from the class of ferrous metal alloys including carbon steel, stainless steel and iron nickel. A first end cap is welded to the lower opened end of the enclosure. A communication port is positioned within the first end of the cap and in communication with the interior of the tubular enclosure. A second end cap is welded to the upper opened end of the enclosure. A volume of water is positioned within the lower region of the tubular enclosure, the upper region being evacuated. An active agent container is formed from a porous tube having a closed lower end and an opened upper end. A current-collecting bar is formed from copper interconnecting an interior portion of the container and the second end of the cap, the active agent being 96 percent by weight of $PbO_x$ and 4 percent by weight $PbSO_4$, wherein x varies between 1.85 and 2.05. The active agent functions such that when non-condensable hydrogen gas is formed within the upper region of the heat pipe, it comes into contact with the active agent through the porous tube such that the hydrogen gas reacts with the active agent to form water and PbO.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved heat pipe which enables improved hydrogen gas oxidization.

It is another object of the present invention to provide a heat pipe which utilizes improved active agent compositions.

It is a further object of the present invention to provide a heat pipe which employs improved containers for use in holding the active agent.

Even still another object of the present invention is to provide a heat pipe which, through improved materials and construction, delivers increased heat transference.

Lastly, it is an object of the present invention to provide a tubular enclosure with upper and lower ends enclosed by end caps. One such end cap employs a communication port such that a working fluid can be introduced into the interior of the pipe. Water is disclosed as the working fluid in the preferred embodiment. The water is adapted absorb heat from the surrounding atmosphere evaporate and condense in the upper portion of the pipe. Typically, a portion of the water reacts with the container to evolve non-condensable hydrogen gas. Such gas diminishes the effectiveness of the pipe. To reduce the hydrogen gas an active agent is employed. The opposite end cap of the pipe includes a container into which a volume of the active agent is positioned. A preferred active agent composition includes 96 percent by weight $PbO_x$ and 4 percent by weight $PbSo_4$. The $PbO_x$ is preferably electrochemically formed, with x varying between 1.85 and 2.05.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

With reference now to the drawings, the preferred embodiments of the new and improved heat pipe embodying the principles and concepts of the present invention will be described.

The present invention relates to a heat exchanger for use in transporting heat in industrial applications. More specifically, the present invention is embodied in a heat pipe which is specifically constructed to reduce the amount of non-condensable hydrogen gas that forms within its interior. The heat pipe of the present invention includes a tubular enclosure which is sealed at either of its ends and into which a volume of water is positioned. This body of water functions as the working fluid of the heat pipe and works in transferring heat from one end of the pipe to the other. The heat pipe of the present invention also includes an active agent container which holds a volume of material adapted to react with any non-condensable hydrogen gas which may collect within the interior of the tubular enclosure. Through such reaction the non-desirable and non-condensable hydrogen gas can be efficiently removed from the interior of the tubular enclosure. The various components of the present invention, and the manner in which they interrelate, will be described in greater detail hereinafter.

Heat Pipe Construction

Figure 1:
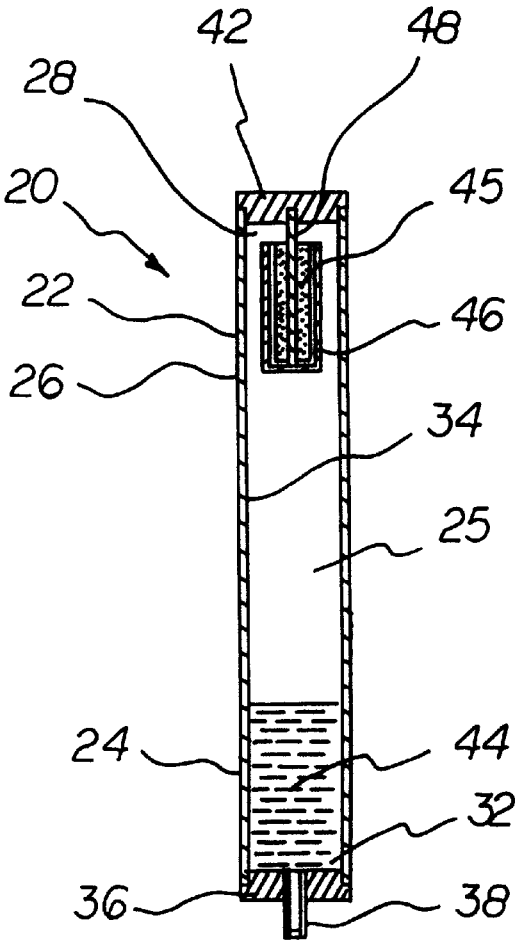
FIG. 1 is an illustration of the preferred embodiment of the heat pipe constructed in accordance with the principles of the present invention.

With reference now to FIG. 1, the primary embodiment of the heat pipe 20 and its associated tubular enclosure 22 is depicted. Such tubular enclosure 22 is defined by a lower region 24, an upper region 26, as well as by upper and lower opened ends, 28 and 32 respectively. A tubular wall 34 extends in between these upper and lower ends (42 and 36) and forms the primary structural feature of the enclosure 22. The wall 34 is preferably formed from a ferrous metal, or a ferrous metal alloy. It has been found that the most beneficial results are achieved when a ferrous metal alloy is selected from the class of ferrous metal alloys including carbon steel, stainless steel and iron nickel. Copper may also be used. Such materials are thermally conductive, and as a consequence, enable the heat exchanger to exchange heat with the outside environment.

With continuing reference to FIG. 1, the end caps which are employed in enclosing the ends of the tubular wall are illustrated. Specifically, a first end cap 36 is included for use in closing off the lower opened end 32 of the enclosure. In the preferred embodiment, this end cap 36 is formed from a thermally conductive material which is similar to that of the tubular wall 34. Furthermore, the end cap 36 is preferably welded to the lower opened end 32 to form a permanent and sealed closure. The first end cap 36 also includes a communication port 38 which is positioned through its thickness. Such a communication port 38 can include sealing means for selectively allowing a user to seal a working fluid within the interior of the tubular enclosure 22. In a similar fashion, a second end cap 42 is welded to the opened upper end 28 of the enclosure 22. This end cap 42, however, does not include a communication port. The welding of the two end caps prevents the liquid or vapor phase of the working fluid from escaping out of the working cavity 25.

As indicated, the heat pipe 20 of the present invention achieves its heat transferring capability by way of a working fluid positioned within the interior of the enclosure. The working fluid functions in transferring heat from one end of the pipe to the other. In the preferred embodiment, the working fluid is water 44. In this regard, a volume of water 44 is adapted to be positioned within the lower region of the tubular enclosure 22. This is achieved through use of the communication port 38. Before the water is positioned, however, the entire enclosure is evacuated of all air. As a consequence, when the water is positioned within the enclosure 22, the working fluid occupies the lower region and the upper region is evacuated.

The heat pipe 20 heretofore described is fully operational. Specifically, the working fluid can be evaporated. As heat is introduced into the heat pipe as a result of conduction through the enclosure and into the working fluid, a portion of the working fluid absorbs the heat and is evaporated. Thereafter, the vapor phase of the working fluid passes into the condenser portion. Then, the vapor phase of the working fluid is condensed as it releases heat through the wall of the condenser portion to the outside. Finally, the condensed liquid phase of the working fluid collects upon the interior surface of the enclosure and flows back into the evaporator potion of the pipe by gravity. The cycle is then repeated.

This cycle described, however, has the drawback that walls of the container react with the working fluid to evolve hydrogen gas. Thus, in a heat pipe constructed with the preferred working fluid and materials, the iron of the enclosure reacts with the water to evolve hydrogen gas. Such hydrogen gas tends to accumulate in the heat pipe condenser section. This accumulation gradually blocks the heat pipe and consequently seriously decreases its heat exchange effectiveness. It is easy to identify this occurrence because of the sharp temperature drop which exists at the gas/vapor interface of the heat pipe.

To correct this, the heat pipe includes an active agent to reduce accumulations of the hydrogen gas. The composition, and method of making such agents, will be described in greater detail hereinafter. The active agent is preferably positioned within an active agent container 46 supported from the end cap 42. The container is most clearly illustrated with reference to FIG. 1. Preferably the container 46 is formed from a porous tube defined by a closed lower end and an opened upper end. The container 46 is suspended from the upper end of the enclosure 22 by way of a bar 48. Preferably the container 46 is lined with fiberglass. The fiberglass lining functions in retaining the active agent and keeping the agent in contact with the bar. Also, the fiberglass prevents the active agent from shedding during the formation process. In the preferred embodiment, the bar 48 is a current-collecting bar formed from copper and is preferably interconnected between an interior portion of the container and the second end of the cap. The active agent 45 is adapted to be stored within the container about the bar 48.

Figure 2:
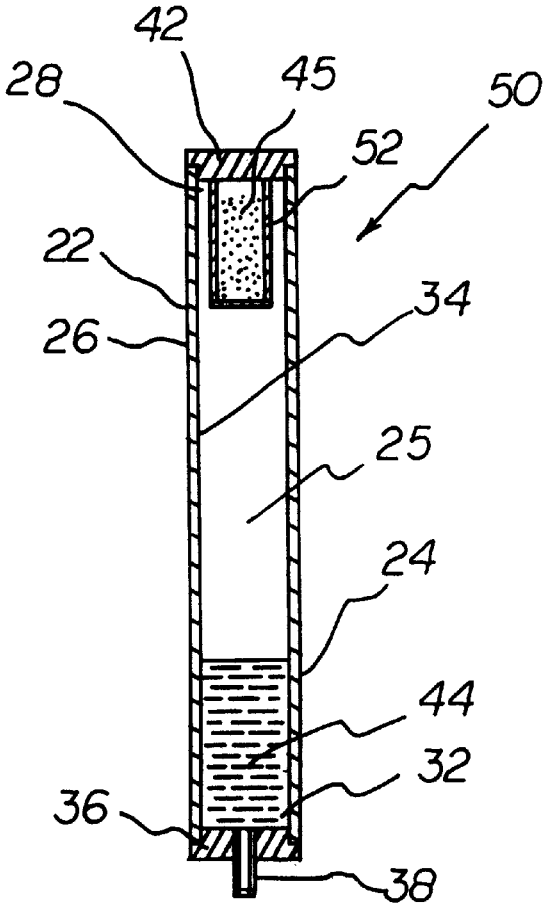
FIG. 2 is an illustration of a secondary embodiment of the heat pipe of the present invention.

Turning now to FIG. 2, an alternative heat pipe structure 50 is disclosed. The pipe 50 of FIG. 2 is similar in most respects to the heat pipe disclosed in conjunction with FIG. 1. However, the active agent container is in the form of a tube 52 which is made from copper or stainless steel. One end of this tube 52 is covered with a porous medium of a metal such as copper or stainless steel. Such a covering is preferably welded to the tube. The active agent employed with this embodiment is ideally in a power form, with the porous end of the tube being sufficient to contain the powder.

Active Agent Compositions

The amount of non-condensable hydrogen gas within the pipe is reduced by the presence of the active agent 45. The active agent 45 comprises substances which are insoluble in the working fluid 44 and which can react with the hydrogen gas generated during operation of the heat pipe to oxidize hydrogen to water. Suitable substances for reacting with the hydrogen gas include $Ni_2O_3$ or $PbO_x$ (wherein x=1.85~2.05). The most preferred form of $PbO_x$ is electrochemically formed in a sulfuric acid solution. Typical electrochemical process are described in *Chemical Power Sources* by W. S. Bagotzky and A. M. Skundin, Academic Press, 1980 (incorporated herein by reference). Preferred substances also include various combinations of $Ni_2O_3$ and electrochemically formed $PbO_x$. The precise active agent compositions will be described in greater detail hereinafter.

The present invention contemplates retaining such substances in active agent containers. The active agent 45 may be disposed in the condenser portion of the heat pipe 20 in block, power, or a specially shaped form. The most efficient active agents have a porous structure for increasing the available contact area with the hydrogen to thereby oxidize the hydrogen gas. To achieve this, the active agent must be disposed within a hydrogen gas permeable container with good structure strength, such as stainless steel or copper porous media. Two examples of such structures are detailed in conjunction with FIGS. 1 and 2.

The specific active agent compositions, and the manner in which they are made, will next be described. A preferred active agent composition has 96 percent by weight of PbOx and 4 percent by weight $PbSO_4$. $PbO_x$ is not fully stoichiometrical and thus x has a value of anywhere between 1.85 and 2.05. The manner is which the active agent breaks down the non-condensable hydrogen gas is described in the following equation: $MO_2+H_2=H_2O+MO$. In this equation, M is a metal element, such as lead (Pb). This equation can be described more generally as $MO_x+H_2=H_2O+MO_{x-1}$.

The exact manner in which the active agent 45 of the present invention is formed also comprises an integral part of the present invention. In the preferred embodiment, the active agent 45 is converted from a paste by way of an electrochemical process. The paste is first prepared by mixing lead powder with sulfuric acid. In the preferred embodiment, the lead powder is produced by grinding pure lead balls. The grinding is done in mills open to the air whereby a considerable amount of the ground lead is oxidized to PbO. The result is a paste 97% PbO and 3% Sulfuric Acid ($H_2So_4$). Alternatively, the paste can be produced from red lead ($Pb_2O_3$), lead monoxide (PbO), and sulfuric acid ($H_2SO_4$). This composition results in a paste having 77% percent by weight lead powder (PbO), 20% percent by weight red lead powder ($Pb_2O_3$), and 3 percent by weight sulfuric acid ($H_2SO_4$).

Whichever paste formulation is utilized, the paste is thereafter packed into the active agent container 46 about the bar 48. Thereafter, the entire active agent container is placed in a sulfuric acid solution. Such solution acts as an electrolyte during subsequent electrochemical formation. The concentration of the sulfuric acid solution depends upon the lead sulfate content in the paste but should vary between 10 percent by weight and 20 percent by weight. Thereafter, a current is passed through the entire paste, preferably to achieve a current density of between 0.001 and 0.01 amps/$cm^2$. This current is preferably changed in two or three steps during the formation. The bar serves as a current collector during this process. Namely, the current can be passed through the bar and into the past to facilitate the formation of the active agent. In the preferred embodiment, this current is passed through the paste anywhere between 20 and 50 hours depending upon the current density. The temperature of the electrolyte used during the formation should not exceed 40 to 50 degrees Celsius. The end product is the desired active agent which contains 96 percent by weight $PbO_x$ and 4 percent by weight lead sulfate ($PbSO_4$) wherein x varies between 1.85 and 2.05.

This active agent is found to have the porous structure which is desirable to achieve the end result. Furthermore, after the formation, the active agent should be washed in water to remove any excess sulfuric acid and thereafter dried at a room temperature of about 80 degrees Celsius. It has been found that this formulation is highly active and is a strong oxidizer which can react with the hydrogen gas at temperatures as low as about 70 degrees Celsius.

Another active agent composition, which can be employed with either the heat pipe construction of FIG. 1 or FIG. 2, employs either $Ni_2O_3$ or $PbO_x$ (wherein x varies between 1.85 and 2.05) wherein PbOx has a crystalline modification. Possible crystalline modifications are the orthorhombic ($\alpha$-$PbO_2$) and the tetragonal ($\beta$-$PbO_2$) These two crystalline modifications are described in *Chemical Power Sources* by V. S. Bagotzky and A. M. Skundin, Academic Press 1980 (which is incorporated herein by reference). Neither $\alpha$-$PbO_2$ or $\beta$-$PbO_2$ are fully stoichiometrical, their composition may be given by $PbO_x$ wherein x=1.85~2.05. $\beta$-$PbO_2$ has a higher specific surface area than $\alpha$-$PbO_2$. Therefore, $\beta$-$PbO_2$ is much more active than $\alpha$-$PbO_2$. One effective active agent comprises a mixture of about 20% by weight of nickel peroxide $Ni_2O_3$ and 80% by weight of $\beta$-$PbO_x$. Furthermore, the $\beta$-$PbO_x$ employed is preferably electrochemically formed in a nitric acid electrolyte solution. One such nitric acid solution contains 2 mol/$dm^3$ of nitric acid ($HNo_3$) and 7 mol/$dm^3$ of lead nitrate ($Pb(NO_3)_2$). Preferably, the solution is positioned within an electrolyte with a cathode and an anode. Thereafter, electric current is passed in between the cathode and anode. Ideally, such electrochemical formation is performed at a current density of 5~10 mA/$cm^2$, depending upon the formation time at the anode. After the electrochemical formation has taken place the resulting $\beta$-$PbO_x$ is removed from the anode. Namely, the electrochemical reaction of Lead Nitrate ($Pb(NO_3)_2$) on the surface of the anode results in the $\beta$-$PbO_x$. Subsequently, the $\beta$-$PbO_x$ is ground in mills which are open to the air. The resulting $\beta$-$PbO_x$ is then mixed with $Ni_2O_3$. This mixture serves as the active agent paste.

METHOD OF THE PRESENT INVENTION

The present invention also pertains to the above described method of forming an active agent within an active agent container. The method contemplates placing an active agent paste within a fiberglass lined active agent container. The paste preferably comprises lead monoxide. The container includes a conductive bar secured to the interior of the container. Thus, the active agent paste is positioned around, and in contact with, the conductive bar. Next, the paste and container are together immersed within an electrolyte. Thereafter, an electric current is passed into the paste by way of the bar. During the flow of such current, the electrolyte acts to facilitate electrochemical formation. The electrolyte is preferably sulfuric acid. After the formation, the active agent is washed in water and then dried in the air. Next, the active agent container, with the included electrochemically formed active agent, is fixed to the upper end cap by way of the bar. An enclosure is also provided, such container is defined by a lower region, an upper region, an upper opened end and a lower opened end. Additionally, a ferrous metal wall extends between the upper and lower ends. The method next contemplates welding the upper end cap, with the attached active agent container, to the upper opened end of the enclosure. Thereafter, a lower end cap, with an associated communication port, is welded to the lower opened end of the enclosure. The next step involves evacuating all air from the interior of the enclosure by way of the communication port. Thereafter, water is positioned within the interior of the enclosure. Finally, the communication port is sealed. The heat pipe is now ready for use.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A heat pipe device which reduces the amount of non-condensable hydrogen gas within its interior, the device comprising:

a tubular enclosure formed from a lower region, an upper region, an upper end and a lower opened end, a tubular wall extending in between the upper and lower ends, the wall being formed from a ferrous metal alloy selected from the class of ferrous metal alloys including carbon steel, stainless steel and iron nickel;

a first end cap welded to the lower opened end of the enclosure, a communication port positioned within the first end of the cap and in communication with the interior of the tubular enclosure, a second end cap welded to the upper opened end of the enclosure;

a volume of water positioned within the lower region of the tubular enclosure, the upper region being evacuated;

an active agent container formed from a porous tube having a closed lower end and an opened upper end, a current-collecting bar formed from copper interconnecting an interior portion of the container and the second end of the cap, the active agent being 96 percent by weight of $PbO_x$ and 4 percent by weight $PbSO_4$, wherein x varies between 1.85 and 2.05; and the active agent functioning such that when non-condensable hydrogen gas is formed within the upper region of the heat pipe, it comes into contact with the active agent through the porous tube such that the hydrogen gas reacts with the active agent to form water and PbO.

2. A heat pipe device which reduces the amount of non-condensable hydrogen gas within its interior, the device comprising:

a tubular enclosure formed from a lower region, an upper region, an upper end and a lower opened end and with an interior portion and an exterior portion, a tubular wall extending in between the upper and lower ends, the wall being formed from a ferrous metal alloy;

a first end cap welded to the lower opened end of the enclosure, and a second end cap welded to the upper opened end of the enclosure;

a volume of water positioned within the lower region of the tubular enclosure;

an active agent container formed from a porous tube having a closed lower end and an opened upper end, a current-collecting bar, a fiberglass lining formed upon the interior portion of the enclosure; and the active agent comprising about 96 percent by weight of $PbO_x$ and 4 percent by weight $PbSO_4$ wherein x varies between 1.85 and 2.05 functioning such that when non-condensable hydrogen gas is formed within the upper region of the heat pipe, it comes into contact with the active agent through the porous tube such that the hydrogen gas reacts with the active agent to form water and PbO.

3. The device as set forth in claim 2 wherein the ferrous metal alloy forming the tubular wall in between the upper and lower ends is selected from the class of ferrous metal alloys including carbon steel, stainless steel and iron nickel.

4. The device as set forth in claim 2 wherein a communication port is positioned within the first end of the cap and in communication with the interior of the tubular enclosure.

5. The device as set forth in claim 2 and further including wherein the upper region of the tubular enclosure is evacuated.

6. The device as set forth in claim 2 wherein the current-collecting bar is formed from copper interconnecting an interior portion of the container and the second end of the cap.

* * * * *